US006411044B2

(12) United States Patent
Wessels et al.

(10) Patent No.: US 6,411,044 B2
(45) Date of Patent: Jun. 25, 2002

(54) SWITCHING DEVICE

(75) Inventors: Johannes Hendrik Wessels; Melanie Maria Jeanne Anna Michon; Machiel Antonius Martinus Hendrix, all of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/793,757

(22) Filed: Feb. 26, 2001

(30) Foreign Application Priority Data

Feb. 29, 2000 (EP) ..... 00200716

(51) Int. Cl.[7] ..... H05B 37/00

(52) U.S. Cl. ..... 315/244; 315/291; 315/307; 315/DIG. 7

(58) Field of Search ..... 315/244, 291, 315/307, 209 R, 247, DIG. 7, 205

(56) References Cited

U.S. PATENT DOCUMENTS

| | | | | | |
|---|---|---|---|---|---|
| 5,426,350 | A | | 6/1995 | Lai | 315/244 |
| 5,463,284 | A | * | 10/1995 | Mattas | 315/227 R |
| 5,677,602 | A | * | 10/1997 | Paul et al. | 315/224 |
| 5,834,903 | A | * | 11/1998 | Christian | 315/219 |
| 6,118,225 | A | * | 9/2000 | Wessels | 315/247 |

* cited by examiner

*Primary Examiner*—Haissa Philogene

(57) ABSTRACT

An electronic ballast for operating a lamp with a high-frequency current is equipped with a load branch comprising two LC combinations. The LC combinations are dimensioned such that the shape of the high-frequency current is in between a sine shape and a square-wave shape. The efficacy of a lamp operated by means of the electronic ballast is high, while the RFI generated by the lamp is low.

5 Claims, 1 Drawing Sheet

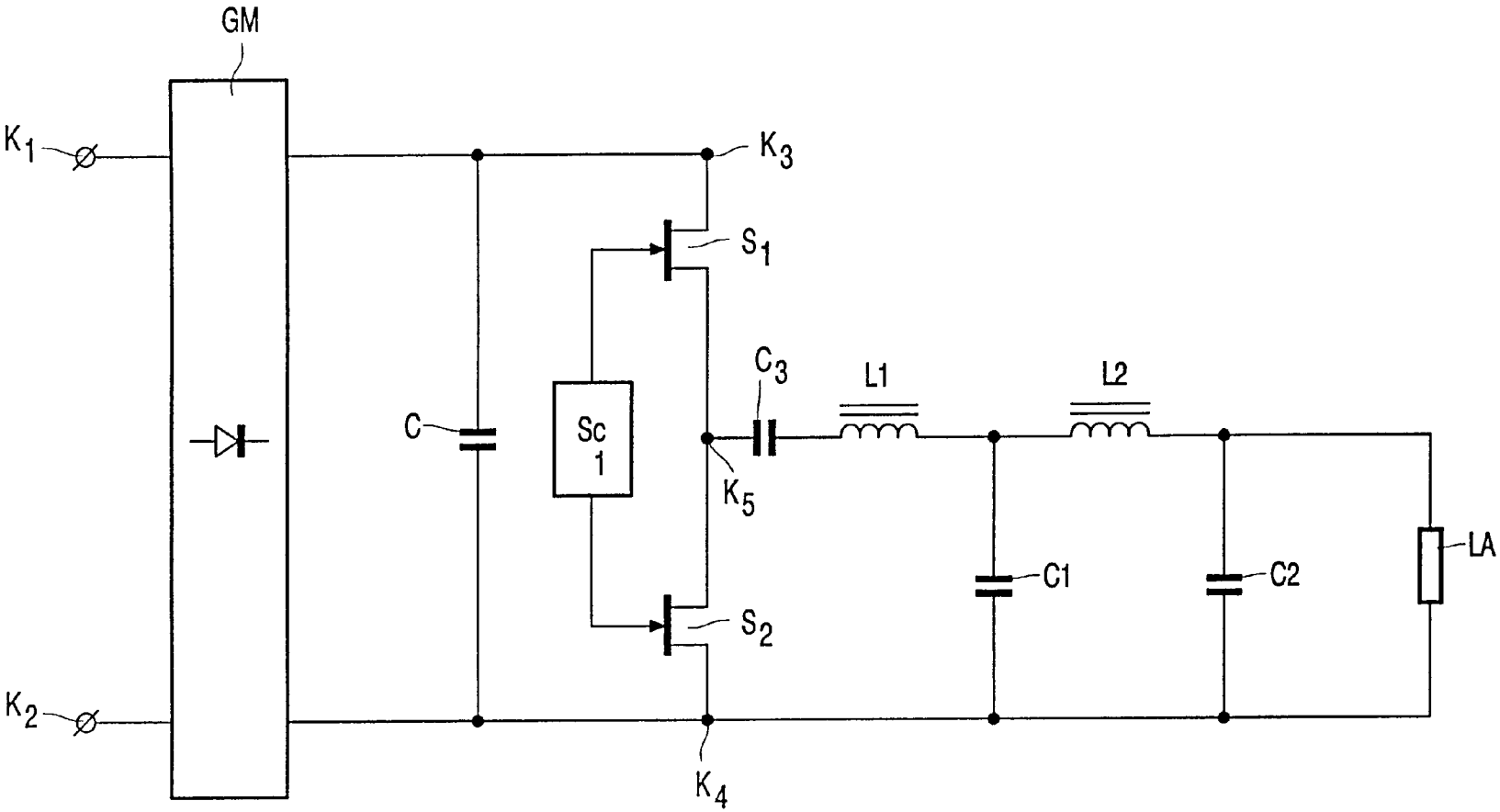
LA
C2
L2
C1
L1
C3
K5
K3
S1
S2
K4
Sc 1
C
GM
K1
K2

SWITCHING DEVICE

BACKGROUND OF THE INVENTION

The invention relates to a switching device for energizing a lamp with a high-frequency lamp current at a frequency f, which switching device is provided with a first circuit part for generating a periodical, substantially square-wave voltage at a frequency f, which first circuit part is provided with output terminals, a load branch comprising a first branch, which interconnects the output terminals, and which comprises a first series arrangement of a first inductive element and a first capacitate element, a second branch, which shunts the first capacitate element, and which comprises a series arrangement of a second inductive element and a second capacitate element, and a third branch, which comprises lamp terminals, and which shunts the second capacitate element during operation of the lamp.

Such a switching device is disclosed in U.S. Pat. No. 5,426,350. A high-frequency current is to be taken to mean a current with a frequency above 10 kHz. In the known switching device, both capacitate elements and both inductive elements are dimensioned such that, during stationary lamp operation, a substantially sinusoidal current flows through the lamp at a frequency f. In spite of the fact that the known switching device does not include a transformer, this sinusoidal current has a comparatively high amplitude as compared to the amplitude of the substantially square-wave voltage. By virtue thereof, it is possible to use the known switching device to supply a comparatively high burning voltage to a discharge lamp.

A drawback of the known switching device is, however, that the efficacy of the lamp, in other words the ratio between the luminous flux of the lamp and the power consumed by the lamp, is comparatively low.

SUMMARY OF THE INVENTION

Therefore, it is an object of the invention to provide a switching device for energizing a lamp, which transfers power to the lamp in such a way that the efficacy of the lamp is comparatively high.

To achieve this, a switching device as described in the opening paragraph is characterized in accordance with the invention in that the first branch and the second branch are dimensioned such that the following relation is met $$0.14<\Sigma A(n)/A(1)<0.42,$$

wherein A(1) denotes the amplitude of the first harmonic component of the high-frequency lamp current, and $\Sigma$ A(n) is the sum of the amplitudes of the higher harmonic components of the lamp current.

Instead of being substantially sinusoidal, the high-frequency lamp current generated during lamp operation by a switching device in accordance with the invention has a shape in between that of a sine and a square-wave. It is known, for example from WO 96/19095, that a substantially square-wave lamp current enables a very high efficacy to be achieved. A drawback of such a substantially square-wave lamp current is the comparatively large amount of RFI generated by the lamp. As the current generated by a switching device in accordance with the invention is not substantially square-wave shaped, but rather has a shape in between that of a sine and a square wave, the amount of RFI generated by the lamp is comparatively small, while the efficacy is substantially higher than in the case of a substantially sine-shaped lamp current. In addition, a switching device in accordance with the invention has a comparatively simple structure and hence is comparatively inexpensive.

Very good results are achieved with embodiments of a switching device in accordance with the invention, wherein the first branch and the second branch are dimensioned such that the following relation is met $$0.21<\Sigma A(n)/A(1)<0.35.$$

It proved advantageous to provide the first circuit part with input terminals which are to be connected to a DC voltage source, a fourth branch comprising a series arrangement of two switching elements, a control circuit coupled to control electrodes of the switching elements for rendering the switching elements alternately conducting and non-conducting.

In this manner, the first circuit part is obtained in a comparatively simple and reliable manner.

To render such an embodiment of a switching device in accordance with the invention suitable for being energized with an AC voltage, the first circuit part may additionally be provided with mains input terminals which are to be connected to a supply-voltage source supplying an AC voltage, rectifier means, coupled to the mains supply terminals and to the input terminals, which rectifier means are used to rectify the AC voltage.

To preclude that comparatively much power is dissipated in the two switching elements, the frequency f is generally chosen to be higher than the resonance frequency of the load branch during operation of the lamp.

These and other aspects of the invention will be apparent from and elucidated with reference to the embodiment(s) described hereinafter.

BRIEF DESCRIPTION OF THE DRAWING

In the drawing:

FIG. 1 diagrammatically shows an example of a switching device in accordance with the invention.

DESCRIPTION OF THE PREFERRED EMBODIMENT

In FIG. 1, K1 and K2 are mains input terminals which are to be connected to a supply-voltage source supplying an AC voltage. The mains input terminals are connected to respective inputs of rectifier means GM which, in this example, are formed by a diode bridge. A first output of the rectifier means GM is connected to a second output by means of a buffer capacitor C. Respective sides of buffer capacitor C are connected to input terminal K3 and input terminal K4. Input terminals K3 and K4 are connected to each other by means of a series arrangement of switching element S1 and switching element S2 which, in this example, forms a fourth branch. A control electrode of switching element S1 is connected to a first output of control circuit Sc1. A control electrode of switching element S2 is connected to a second output of control circuit Sc1. Control circuit Sc1 is, in this example, a control circuit for rendering the switching elements S1 and S2 alternately conducting and non-conducting.

Switching elements S1 and S2 and the control circuit Sc1 jointly form a first circuit part for generating a periodical, substantially square-wave voltage at a frequency f. In this example, a junction point of the two switching elements S1 and S2 forms a first output terminal K5 of the first circuit part. A second output terminal of the first circuit part is formed by input terminal K4. Switching element S2 is shunted by a series arrangement of capacitor C3, coil L1 and capacitor C1. Coil L1 forms a first inductive element, and capacitor Cl forms a first capacitate element. Capacitor C3 forms a DC-blocking capacitor, which is used to preclude that the lamp carries a direct current during operation of the lamp. Capacitor C1 is shunted by a series arrangement of coil L2 and capacitor C2. Coil L2 forms, in this example, a second inductive element. Capacitor C2 forms, in this example, a second capacitate element. Capacitor C3 has a comparatively large capacitance as compared to the capacitance's of capacitor C1 and capacitor C2.

The dimensions of the first branch and the second branch are such that the following relation is met $$0.14<\Sigma A(n)/A(1)<0.42,$$

wherein A(1) is the amplitude of the first harmonic component of the high-frequency lamp current and Σ A(n) is the sum of the amplitudes of the higher harmonic components of the lamp current. Capacitor C2 is shunted by the discharge lamp LA.

The operation of the example shown in FIG. 1 is described hereinbelow.

If the mains input terminals K1 and K2 are connected to a supply-voltage source supplying an AC voltage, then the rectifier means GM rectify this AC voltage to a DC voltage present across the buffer capacitor C. The control circuit Sc1 renders the switching elements S1 and S2 alternately conducting and non-conducting at a frequency f. As a result, between the output terminals K4 and K5 a symmetric substantially square-wave voltage is present at a frequency f. As a result of the dimensioning of the first and the second branch, the current through the lamp LA has a shape in between a square-wave shape and a sine shape. In this manner, it is achieved that the efficacy of the switching device shown in FIG. 1 is comparatively high, while the quantity of RFI generated by the lamp LA is comparatively low.

In a practical embodiment of the example shown in FIG. 1, the frequency f is chosen to be 50 kHz. The induction of coil L1 is 1.15 mH and the induction of coil L2 is 0.8 mH. The capacitances of the capacitors C1, C2 and C3 are, respectively, 3.3 nF, 3.9 nF and 100 nF. The lamp energized by means of the switching device is a low-pressure mercury vapor discharge lamp of the type T5 (Philips) having a rated power of 39 W. It has been found that the efficacy of the lamp is 2.4% higher than the efficacy achieved by using a sinusoidal lamp current. The quantity of RFI generated by the lamp is hardly higher than that generated in the case of a sinusoidal lamp current.

What is claimed is:

1. A switching device for energizing a lamp with a high-frequency lamp current at a frequency f, which switching device is provided with a first circuit part for generating a periodical, substantially square-wave voltage at a frequency f, which first circuit part is provided with output terminals, a load branch comprising a first branch, which interconnects the output terminals, and which comprises a first series arrangement of a first inductive element and a first capacitive element, a second branch, which shunts the first capacitive element, and which comprises a series arrangement of a second inductive element and a second capacitive element, and a third branch, which comprises lamp terminals, and which shunts the second capacitive element during operation of the lamp, characterized in that the first branch and the second branch are dimensioned such that, during lamp operation, the following relation is met $$0.14<\Sigma A(n)/A(1)<0.42,$$

wherein A(1) denotes the amplitude of the first harmonic component of the high-frequency lamp current, and Σ A(n) is the sum of the amplitudes of the higher harmonic components of the lamp current.

2. A switching device as claimed in claim 1, wherein the first branch and the second branch are dimensioned such that the following relation is met $$0.21<\Sigma A(n)/A(1)<0.35.$$

3. A switching device as claimed in claim 1 or 2, wherein the first circuit part is provided with input terminals which are to be connected to a DC voltage source, a fourth branch comprising a series arrangement of two switching elements, a control circuit coupled to control electrodes of the switching elements for rendering the switching elements alternately conducting and non-conducting.

4. A switching device as claimed in claim 3, wherein the first circuit part is provided with mains input terminals which are to be connected to a supply-voltage source supplying an AC voltage, rectifier means, coupled to the mains supply terminals and to the input terminals, which rectifier means are used to rectify the AC voltage.

5. A switching device as claimed in claim 3, wherein the frequency f is higher than the resonance frequency of the load branch during operation of the lamp.

* * * * *